United States Patent [19]

Fischer

[11] 4,164,090

[45] Aug. 14, 1979

[54] ASSEMBLY KIT FOR ASSEMBLING A TOY VEHICLE

[76] Inventor: Artur Fischer, Weinhalde 34, D-7244 Waldachtal 3 (Tumlingen), Fed. Rep. of Germany

[21] Appl. No.: 815,410

[22] Filed: Jul. 13, 1977

[30] Foreign Application Priority Data

Jul. 20, 1976 [DE] Fed. Rep. of Germany ..... 7622810

[51] Int. Cl.[2] ..... A63H 33/06

[52] U.S. Cl. ..... 46/17; 46/201; 46/221

[58] Field of Search ..... 46/201, 221, 222, 223, 46/16, 17

[56] References Cited

U.S. PATENT DOCUMENTS 3,091,888 6/1963 Patch ..... 46/17

3,611,629 10/1971 Foley et al. ..... 46/201

3,629,968 12/1971 Linstead ..... 46/17

*Primary Examiner*—Louis G. Mancene

*Assistant Examiner*—Robert F. Cutting

*Attorney, Agent, or Firm*—Michael J. Striker

[57] ABSTRACT

An assembly kit for assembling a toy vehicle has an upper part provided with an undercut groove on a lower end surface thereof, and a lower part including structural elements each provided with a bar-shaped undercut element engaging the undercut groove so as to connect the lower and the upper parts with one another. The upper part is hollow, whereas the lower part is plate-like and is additionally provided with two axle end portions for mounting wheels of the vehicle thereon. The bar-shaped undercut element has an elongated groove and is located between the axle end portions in alignment with the latter.

7 Claims, 1 Drawing Figure

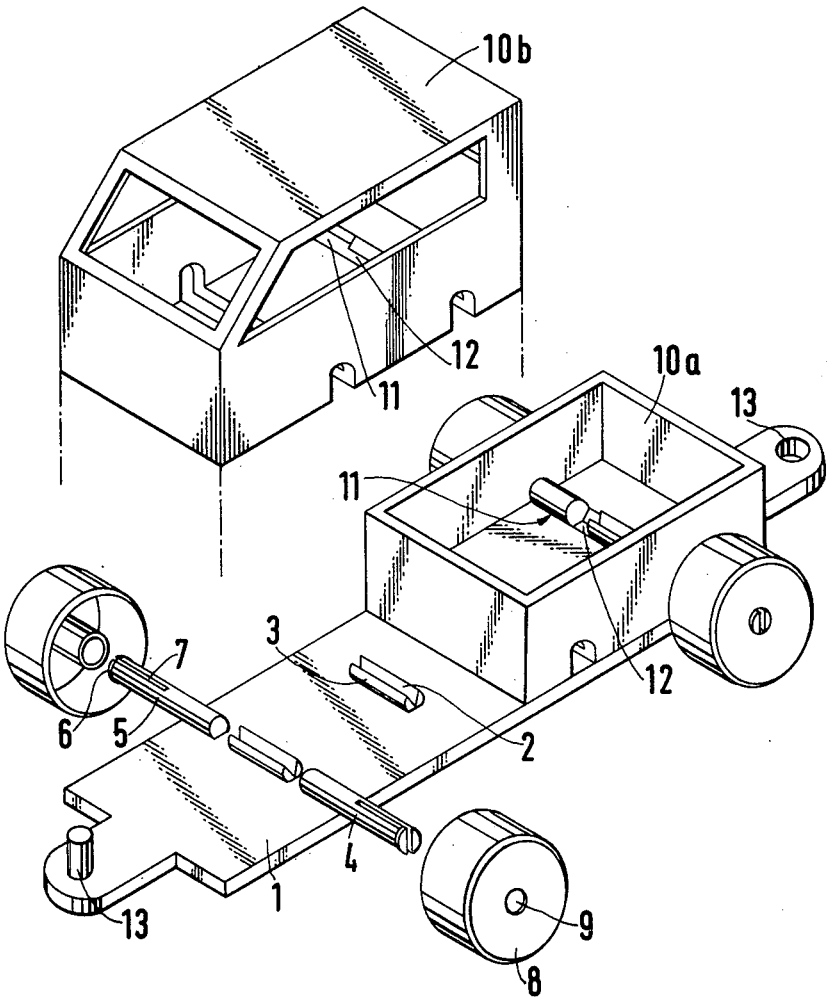
10b
12
11
10a
13
11
12
3
7
6
5
2
4
1
13
9
8

ASSEMBLY KIT FOR ASSEMBLING A TOY VEHICLE

BACKGROUND OF THE INVENTION

The present invention relates to an assembly kit for assembling a toy vehicle. More particulary, the present invention relates to an assembly kit for assembling a toy vehicle which comprises at least two parts assemblable with one another by means of interengaging undercut formations.

Construction kits have been proposed in the art including two parts provided with an undercut groove and an undercut projection, respectively. Such kits may be used both for assembling immovable toy models and vehicle models. The thus connected parts of the structural blocks are secured against sliding relative to one another and have proved to be best for children who play with construction kits. The children insert the undercut projection into the undercut groove by passing the former through an open end of the latter and slidable moving the projection lengthwise of the groove. However, the technical experience of small children is sometimes insufficient to understand a process of passing the projections through the grooves, and therefore they have difficulties in assembling of the respective toys. For such children the connection which includes assembling a toy by pressing the parts thereof against one another and engaging the parts with one another with a snap action, is much easier to learn. Furthermore, structural elements of the known structural blocks essentially differ from each other in their functions so that both a lower part of the toy vehicle and an upper part thereof must be assembled of a considerable number of the structural elements. Moreover, a plurality of the different structural elements which form the structural block worsens the aesthetic features of the entire design of the toy assembled of such structural elements.

SUMMARY OF THE INVENTION

Accordingly, it is an object of the present invention to provide an assembly kit for assembling a toy vehicle which avoids the disadvantages of the prior art structural blocks.

More particularly, it is an object of the present invention to provide an assembly kit for assembling of a toy vehicle which permits easy and convenient assembly of the same by small children.

Another object of the present invention is to provide an assembly kit which permits assembling of stable and naturally looking toy vehicles, including a substantially small number of component parts.

Still another object of the present invention is to provide an assembly kit for assembling a toy vehicle, permitting connection of component parts with a snap action which is easy to be understood by children.

In keeping with these objects, and with others which will become apparent hereinafter, one feature of the present invention resides, briefly stated, in a structural block for assembling a toy vehicle, comprising an upper part including at least two structural elements each having a lower end surface provided with an undercut groove, and an integral plate-like lower part having an upper end surface for positioning the lower end surface of the upper part thereon. The lower part is provided with an undercut projection engaging the undercut groove of the upper part to thereby connect these parts with one another.

In this construction the structural elements which form the upper part are hollow and have a width corresponding to the width of the toy vehicle. This means that the entire upper half of the toy vehicles is subdivided into several upper parts only in a longitudinal direction. In this case a playing child by selection of the different hollow structural elements, on the one hand, and by selection of a different number of such structural elements, has a possibility to assemble the toy vehicle in accordance with his taste. This is facilitated by the fact that the lower part is formed as an integral member and is provided with the undercut projection engageable with the undercut groove of the upper part. The playing child presses the structural elements of the upper part from above against the lower part, and the former are connected with the latter by interengagement of the undercut groove and projection with the snap action.

Another feature of the present invention is that the lower part is provided with axle end portions which are integral with the lower part and serve for mounting tires of the toy vehicle thereon. With the thus constructed parts a process of assembling the toy vehicle consists of a very limited number of steps. It is sufficient to put the upper parts onto the lower part and to mount the wheels on the axle end portion projecting laterally beyond the lower part.

Since the undercut groove of the upper part and the undercut projection of the lower part have a complementary configuration, a playing child can connect the parts with one another by slidably moving the undercut projection lengthwise of the undercut groove. Since the undercut projection is provided with the slot, those children who are not sufficiently advanced in the learning process can connect the parts by transversely pressing the structural elements of the upper part against the lower part so that the undercut projection enters the undercut groove transversely and with a snap action. During such pressing, the undercut projection is first compressed and the slot thereof is reduced in a transverse direction, and thereafter a wall which bounds the slot is again spread apart so as to firmly clamp walls which bound the undercut groove of the lower part. The snap connection of the lower part and the upper part prevents sliding of these parts relative to one another.

Still another feature of the present invention is that the undercut groove of the structural elements of the upper part has two enlarged end portions. The enlarged portions each have a length corresponding to a part of the length of the undercut groove, and a depth corresponding to the largest cross-section of the undercut projection. Because the undercut groove has the above two enlarged end portions, the portions of the upper part in which the enlarged portion of the undercut groove is formed has a reduced rigidity, and the portion of the upper part located between the portions of the reduced rigidity has an increased deformability. This facilitates the snap-action insertion of the undercut projection into the undercut groove and thereby facilitates the connection of the lower part and the structural elements of the upper part with each other.

An additional feature of the present invention is that a length of the axle end portions mounted on the lower part of the structural block corresponds to the length of the enlarged portions of the undercut grooves of the structural elements of the upper part, and that the undercut projection is located between the axle end portion in alignment therewith. This makes it possible to so form the axle end portions in the region of their connection with the lower part, that these axle end portions have a cylindrical cross-section and do not need to be provided with slots to make them sufficiently yieldable for insertion into the groove with a snap connection due to the fact that the portions bounding the groove itself are now yieldable.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE of the drawing shows an assembled kit for assembling a toy vehicle, in accordance with the present invention.

DESCRIPTION OF A PREFERRED EMBODIMENT

The single Figure of the drawing shows an assembly kit for assembling a toy vehicle, including a lower part 1. Undercut bar-shaped connecting elements 3 are mounted on an upper surface of the lower part 1 and each has a slot 2. As shown in the drawing, the undercut elements 3 and the slots 2 thereof extend in a transverse direction so that each slot 2 extends in the direction of elongation of and cuts through the respective undercut element 3. Axle end portions 4 are further mounted on the upper surface of the lower part 1 and each has a section 5 laterally projecting beyond the lower plate 1. Flanges 6 are provided on free ends of the axle end portions 4. Slots 7 are formed in the axle end portions 4 and each extends from the respective free end thereof. The sections 5 of the axle end portions 4 serve for mounting thereon tires 8 of the toy vehicle each of which tire has a bore 9.

Hollow structural elements **10*a* and 10*b* together form the upper part of the toy vehicle, and each has grooves 12 extending in the transverse direction. Each groove 12 has two enlarged end portions 11 spaced from one another in the direction of elongation of the groove. Widths of each of the enlarged portions 11 of the grooves 12 correspond to the largest cross-section of the undercut elements 3. The hollow structural elements 10*a* and 10*b* are so formed that each of them is independent and they can be combined with each other in different combinations. The hollow structural element 10*b*** is formed and dimensioned so that it can be used for assembling of a toy vehicle of any desirable type.

The enlarged portions 11 of the undercut grooves 12 reduce the rigidity of the regions of the structural elements **10*a*, 10*b*** which are located adjacent to the side walls thereof, and increase deformability of intermediate regions thereof.

Additional coupling elements 13 are provided for coupling the toy vehicles with each other.

For assembling of a toy vehicle the structural elements **10*a* and 10*b* of the upper part are mounted on the lower part 1. This may be done by pressing the structural elements against the upper surface of the lower part so that the undercut grooves 12 engage with the undercut elements 3. The enlarged portions 11 of the undercut grooves 12 outwardly surround the axle end portions 4 of the lower part 1. Then, the tires 8 are mounted on the axle end portions 4** by moving the wheels in the transverse direction.

It will be understood that each of the elements described above, or two or more together, may also find a useful application in other types of constructions differing from the types described above.

While the invention has been illustrated and described in an assembly kit for assembling a toy vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An assembly kit for assembling a toy vehicle having tires, comprising a lower part including a body portion having an upper surface, a plurality of elongated undercut projections located on said upper surface of said body part and each extending in a first direction, each of said projections having a slot which cuts through and extends in the direction of elongation of a respective projection, and a plurality of pairs of elongated axle portions for mounting the tires thereon, said axle portions being mounted on said upper surface of said body portion and also extending in said first direction, said projections and said axle portions being of one piece with said body portion so as to form together a one-piece member defining said lower part; and a hollow body part including at least two hollow upper structural elements each having a shape corresponding to the shape of a toy vehicle to be assembled, each of said upper structural elements having a lower surface provided with elongated undercut grooves which extend in said first direction and each have two enlarged end portions spaced from one another in said first direction, each of said enlarged end portions having a length corresponding to a part of the length of a respective undercut groove, and a width corresponding to the largest cross-section of said undercut projections of said lower part, whereby each of said structural elements of said upper part can be connected with said lower part by movement of said structural element both in said first direction and in a direction transverse to said first direction so that the undercut projection of said lower part engages in the undercut groove of the structural element of said upper part.

2. The assembly kit as defined in claim 1, wherein said structural elements are hollow and have dimensions which are compatible with the dimensions of the toy vehicle to be assembled.

3. The assembly kit as defined in claim 1, wherein said undercut projection have a cylindrical shape.

4. The assembly kit as defined in claim 1, wherein each of said axle end portions has a section located on said upper surface of said lower part and having a length corresponding to the length of the respective enlarged portion of said undercut groove of the respective structural element.

5. The assembly kit as defined in claim 1, wherein each of at least some of said undercut projections is located between the axle portions of the respective pair and in alignment therewith.

6. The assembly kit as defined in claim 1, wherein said undercut projection is a bar-shaped member.

7. The assembly kit as defined in claim 1, wherein each of said structural elements has a lower wall in which a respective undercut groove is formed, said wall having a central section which is located between said enlarged portions of said groove and is rendered deformable as a result of the provision of said enlarged portions of said groove, so that each undercut projection of said lower part can engage in a respective undercut groove with snap action by movement in said transverse direction.

* * * * *